US008393762B2

(12) United States Patent
Wu

(10) Patent No.: US 8,393,762 B2
(45) Date of Patent: Mar. 12, 2013

(54) MAGNETIC LAMPSHADE FRAME ASSEMBLY

(76) Inventor: Wilson Wu, Taipei (TW)

( * ) Notice: Subject to any disclaimer, the term of this patent is extended or adjusted under 35 U.S.C. 154(b) by 116 days.

(21) Appl. No.: 13/176,985

(22) Filed: Jul. 6, 2011

(65) Prior Publication Data

US 2013/0010477 A1 Jan. 10, 2013

(51) Int. Cl.
*F21V 11/06* (2006.01)

(52) U.S. Cl. ..... 362/352; 362/351; 362/358; 362/398

(58) Field of Classification Search ..... 362/351, 362/352, 358, 359, 361, 398
See application file for complete search history.

(56) References Cited

U.S. PATENT DOCUMENTS 2,702,341 A * 2/1955 Tradelius ..... 362/358
2,853,597 A * 9/1958 Hartman ..... 362/311.14
3,023,307 A * 2/1962 Okamoto ..... 362/352
6,010,235 A * 1/2000 Sawyer ..... 362/351
6,886,966 B2 * 5/2005 Humphrey ..... 362/417
2009/0225553 A1 9/2009 Wu

FOREIGN PATENT DOCUMENTS

TW M350672 2/2009

* cited by examiner

*Primary Examiner* — Ali Alavi
(74) *Attorney, Agent, or Firm* — Muncy, Geissler, Olds & Lowe, PLLC

(57) ABSTRACT

A magnetic lampshade frame assembly comprises: a frame device, including upper and lower frames; a hood device, including a hood, a connecting strip separately formed at upper and lower positions of an internal side of the hood, and an external side of the connecting strip being fixed to the hood, and an internal side of the connecting strip being magnetically coupled to the upper frame or the lower frame, and at least one of the connecting strip and the upper frame or at least one of the connecting strip and the lower frame is made of a magnetic material, so as to achieve the effects of saving the material of the lamp, assembling or disassembly a lampshade quickly and conveniently, avoiding damages of a lampshade, providing a secured connection between the hood and the frame, and improving the texture to enhance the added value of the lamp product.

10 Claims, 8 Drawing Sheets

MAGNETIC LAMPSHADE FRAME ASSEMBLY

BACKGROUND OF THE INVENTION

1. Field of the Invention:

The present invention relates to a lampshade structure of a lamp, particularly to a magnetic lampshade frame structure with a convenient and secured assembly, and cost-effective and high-quality features.

2. Brief Description of the Related Art:

Lamp is a common electric appliance used at home to provide necessary illuminations, create different atmospheres, and plays an important role in the interior design of modern homes. Various lamps such as ceiling lamps, floor lamps, wall lamps and table lamps are provided for different applications, and a lamp with a lampshade is usually used for creating indoor atmospheres. The lampshade can soften the light and adjust the brightness and color of the light. Conventional lampshades for a lamp are mainly divided into fixed lampshades and removable lampshades. However, the fixed lampshade has a large packaging volume which is unfavorable for transportation and storage, and incurs a higher cost or easier damage during the transportation process. Therefore, the removable lampshades are introduced to the market. For example, the removable lampshade as disclosed in R.O.C. Pat. No. M350672 provides a simple and easy way of installing and removing a lampshade frame and a hood connected by Velcro tapes, such that the lampshade frame and the hood can be packaged separately, and such removable lampshade can save packaging and transportation costs. Although such conventional lampshade structure can be assembled and disassembled, it still has the following drawbacks. For example, the upper frame and the lower frame are attached by the Velcro tapes, and they must have sufficient area for the tapes, so that that the upper frame and the lower frame will come with a larger volume and a heavier weight and result in a higher material cost. Furthermore, the lampshade assembled by the Velcro tapes gives a poor appearance. Obviously, the conventional lampshade frame structure requires improvement, and it is a main subject for related manufacturers and designers to provide an improved lampshade frame structure to overcome the aforementioned manufacturing and using drawbacks.

In view of the shortcomings and the weak structural design of the conventional the lampshade structure, the inventor of the present invention developed a magnetic lampshade frame assembly with the effects of saving the material, reducing the weight, and improving the quality of the lampshade frame.

SUMMARY OF THE INVENTION

Therefore, it is a primary objective of the present invention to provide a magnetic lampshade frame assembly capable of saving the material of the lamp, providing a quick and convenient way of assembling or disassembly a lampshade, and avoiding possible damages of a lampshade.

Another objective of the present invention is to provide a magnetic lampshade frame assembly, wherein a hood and a frame of the assembly can be combined more securely, and the texture of the assembly can be improved to enhance the added value of the lamp products.

To achieve the foregoing objectives, the technical measure taken by the present invention comprises: a frame device, including an upper frame and a lower frame; a hood device, including a hood, a connecting strip separately formed at upper and lower positions of an internal side of the hood, and an external side of the connecting strip being fixed to the hood, and an internal side of the connecting strip being magnetically coupled to the upper frame or the lower frame, and at least one of the connecting strip and the upper frame or at least one of the connecting strip and the lower frame is made of a magnetic material.

The technical characteristics and effects of the present invention will become apparent by the detailed description of the preferred embodiments together with the illustration of related drawings as follows:

BRIEF DESCRIPTION OF THE INVENTION

Figure 2:
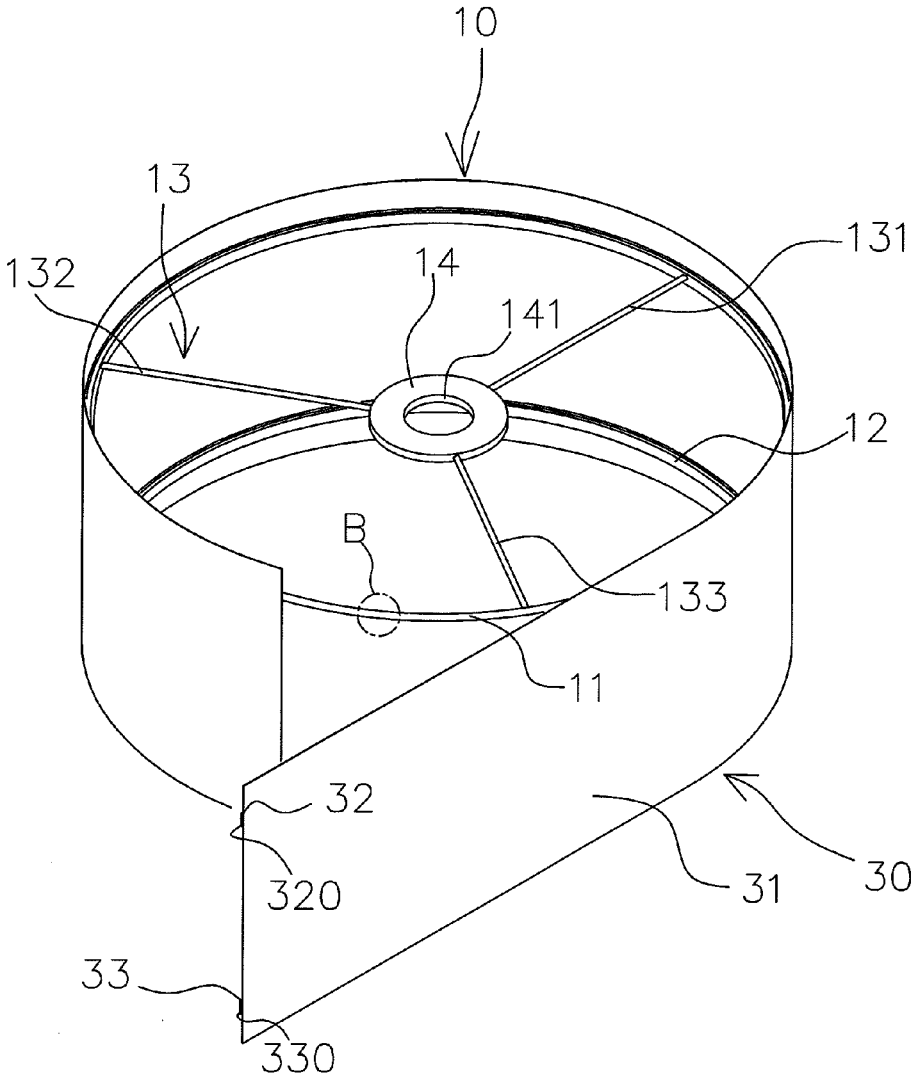
FIG. 2 is a partial perspective view of the first preferred embodiment of the present invention.
Figure 2A:
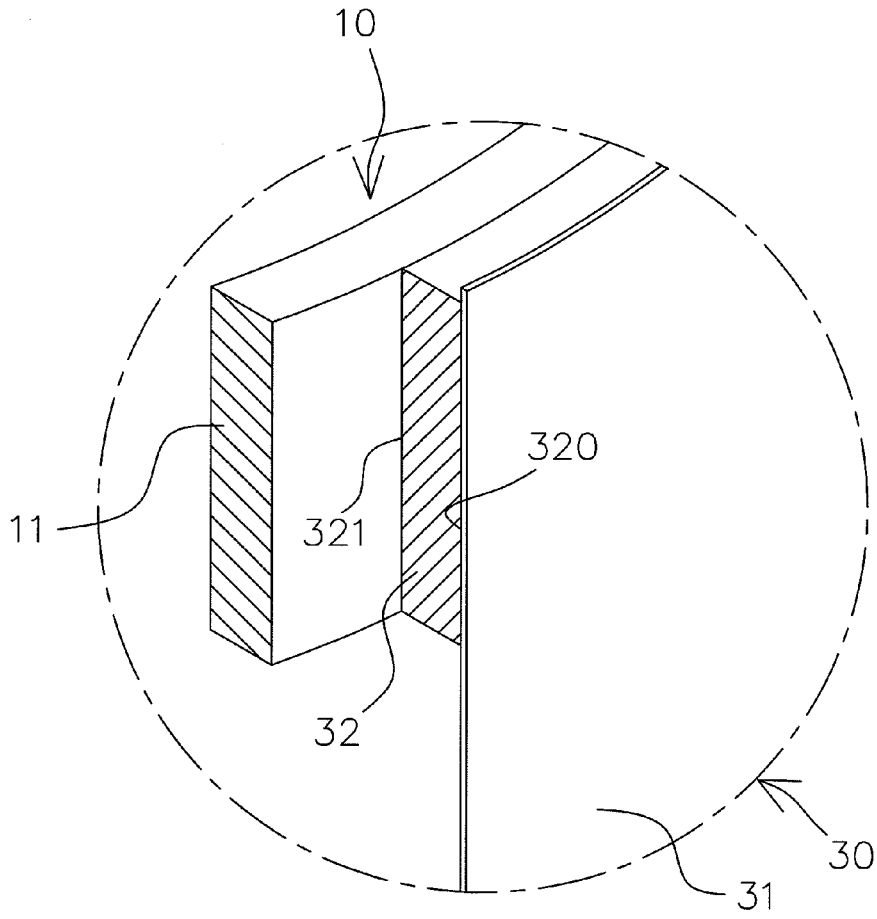
Figure 3:
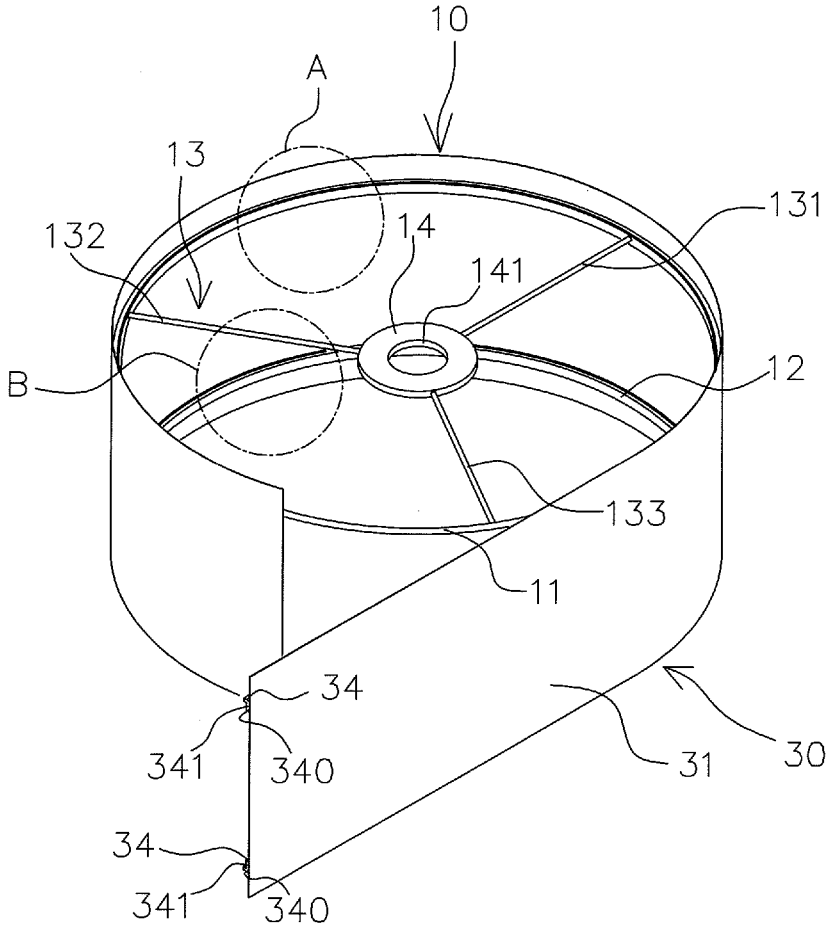
Figure 3A:
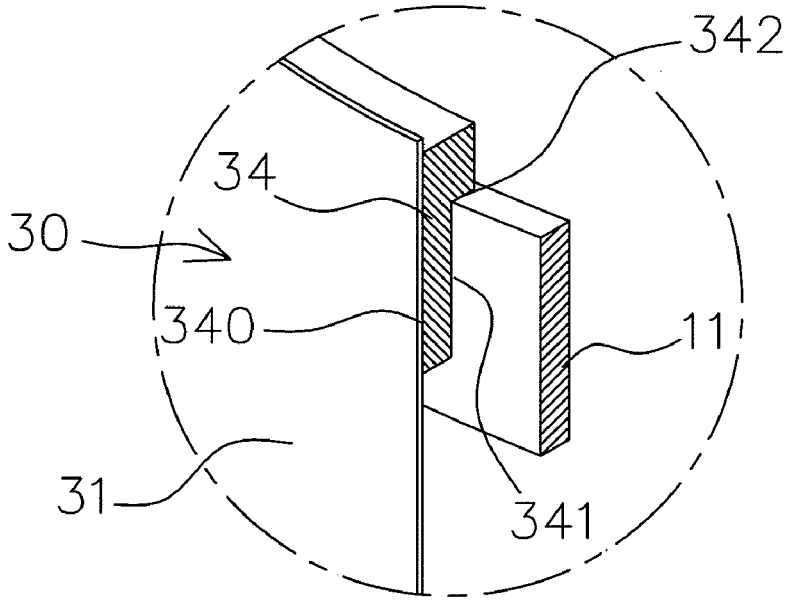
Figure 3B:
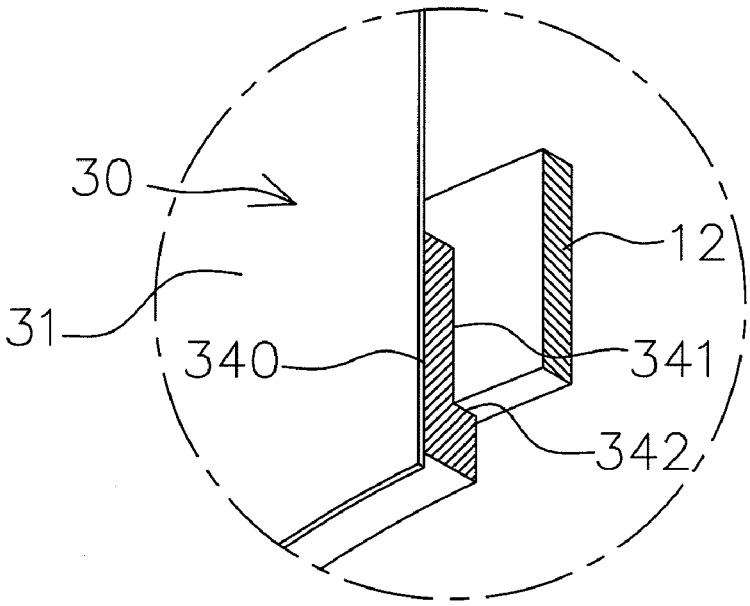
Figure 4:
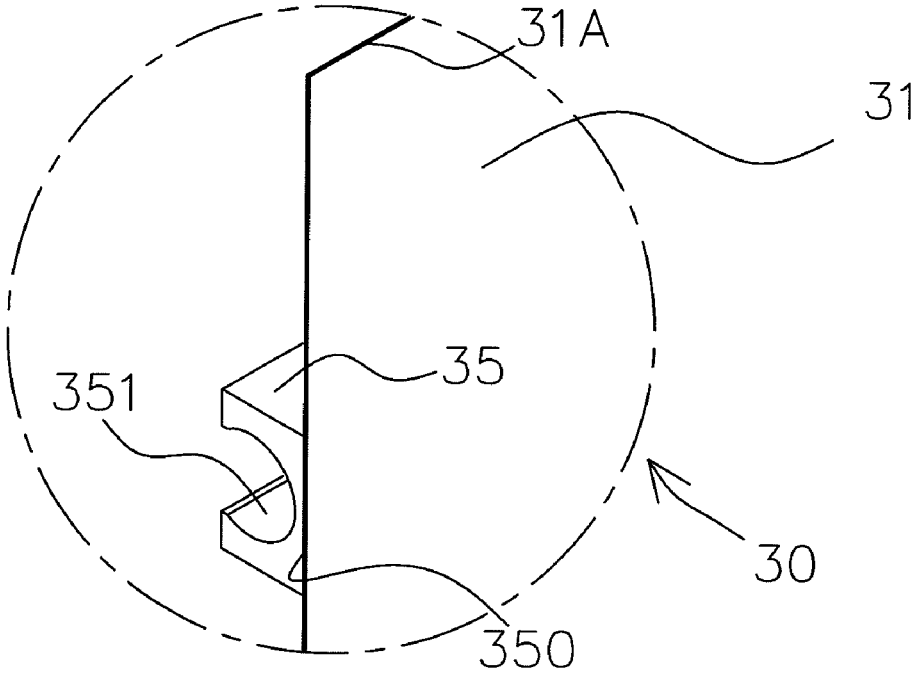
Figure 5:
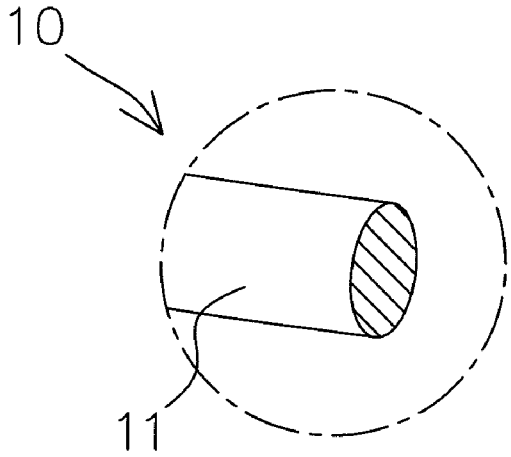
Figure 6:
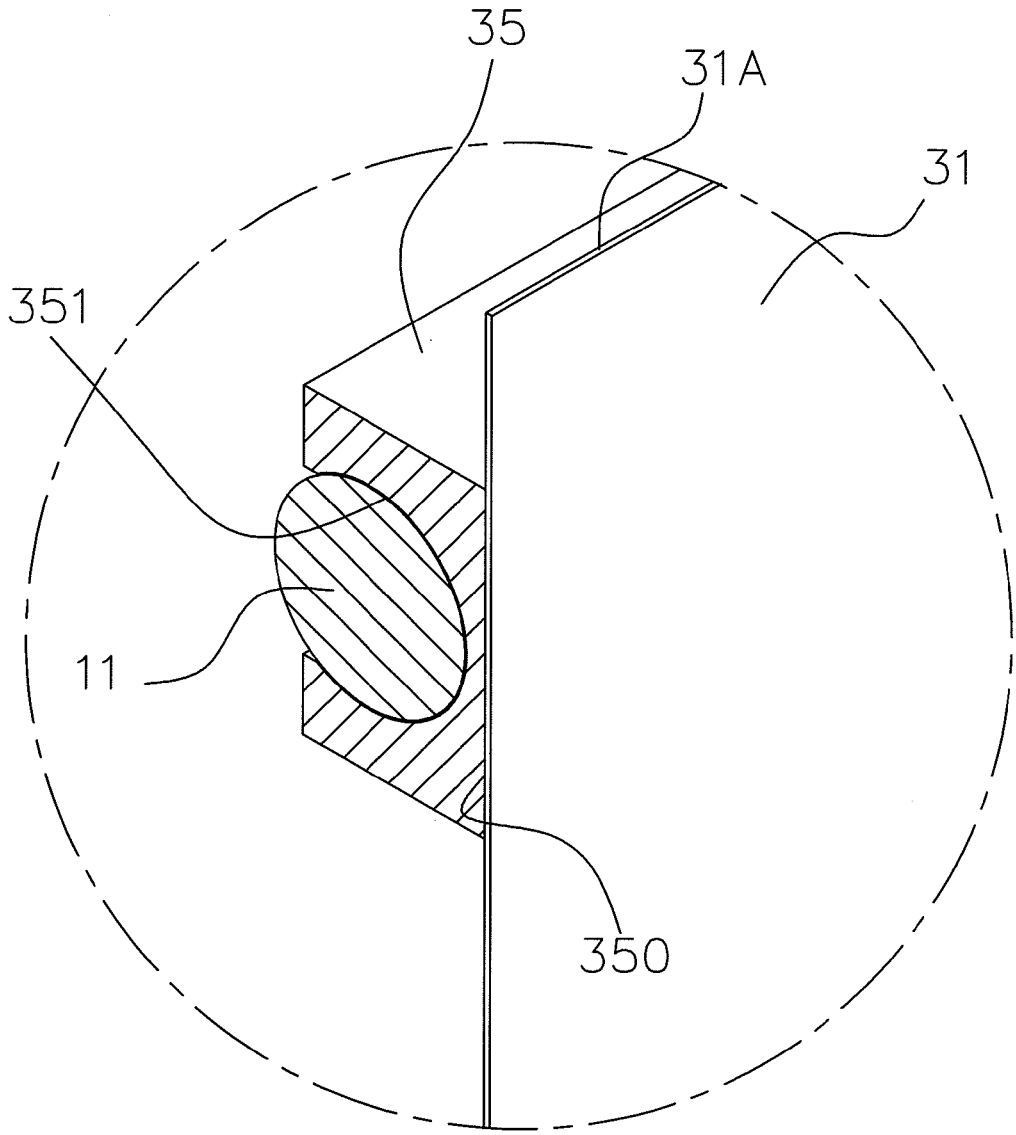
Figure 7:
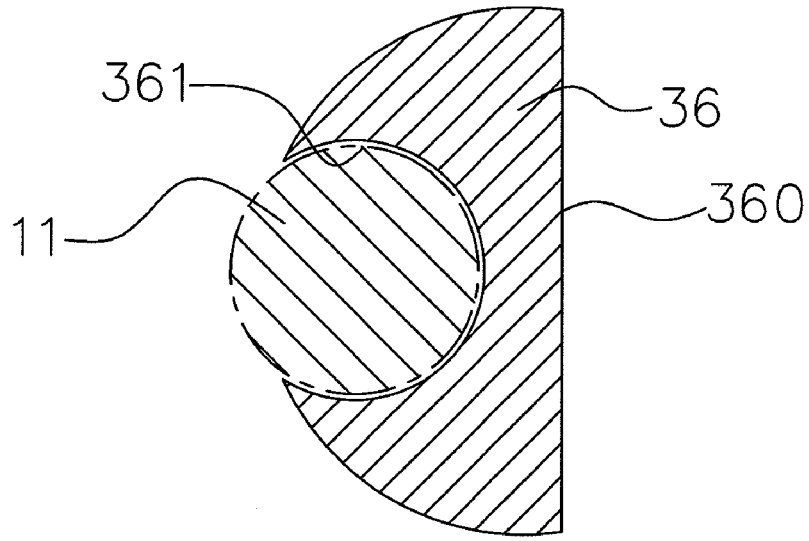
Figure 8:
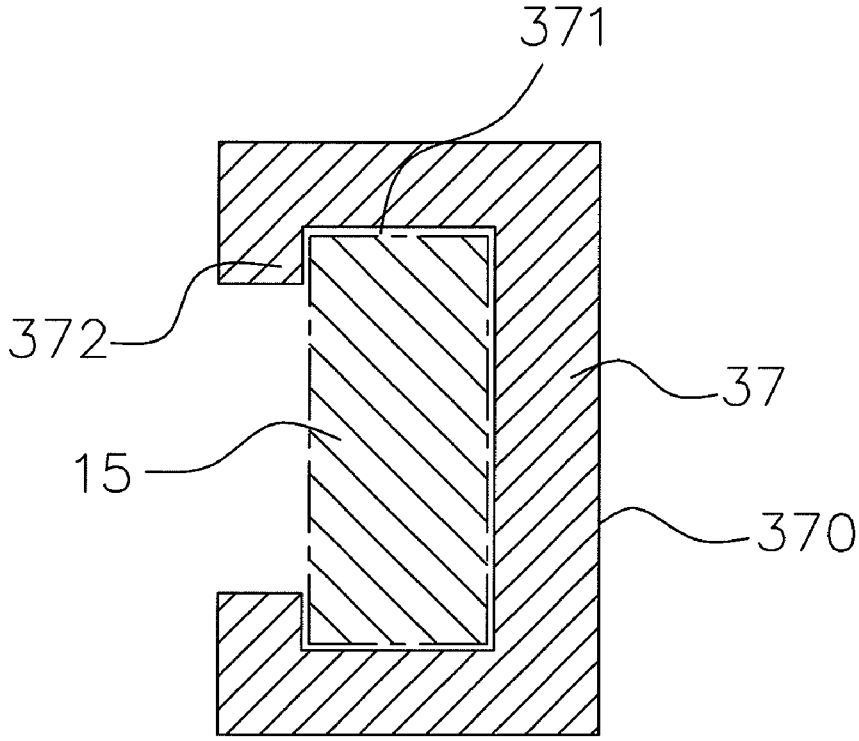

FIG. 2*a* is a close-up view of FIG. 2;

FIG. 3 is a partial perspective view of a second preferred embodiment of the present invention;

FIG. 3*a* is partial close-up view of the portion A of FIG. 3;

FIG. 3*b* is partial close-up view of the portion B of FIG. 3;

FIG. 4 is a schematic view of a connecting strip in accordance with a third preferred embodiment of the present invention;

FIG. 5 is a schematic view of upper and lower frames in accordance with the third preferred embodiment of the present invention;

FIG. 6 is a partial perspective view of the third preferred embodiment of the present invention;

FIG. 7 is a partial perspective view of a fourth preferred embodiment of the present invention;

FIG. 8 is a partial perspective view of a fifth preferred embodiment of the present invention.

DETAILED DESCRIPTION OF THE PREFERRED EMBODIMENTS

Figure 1:
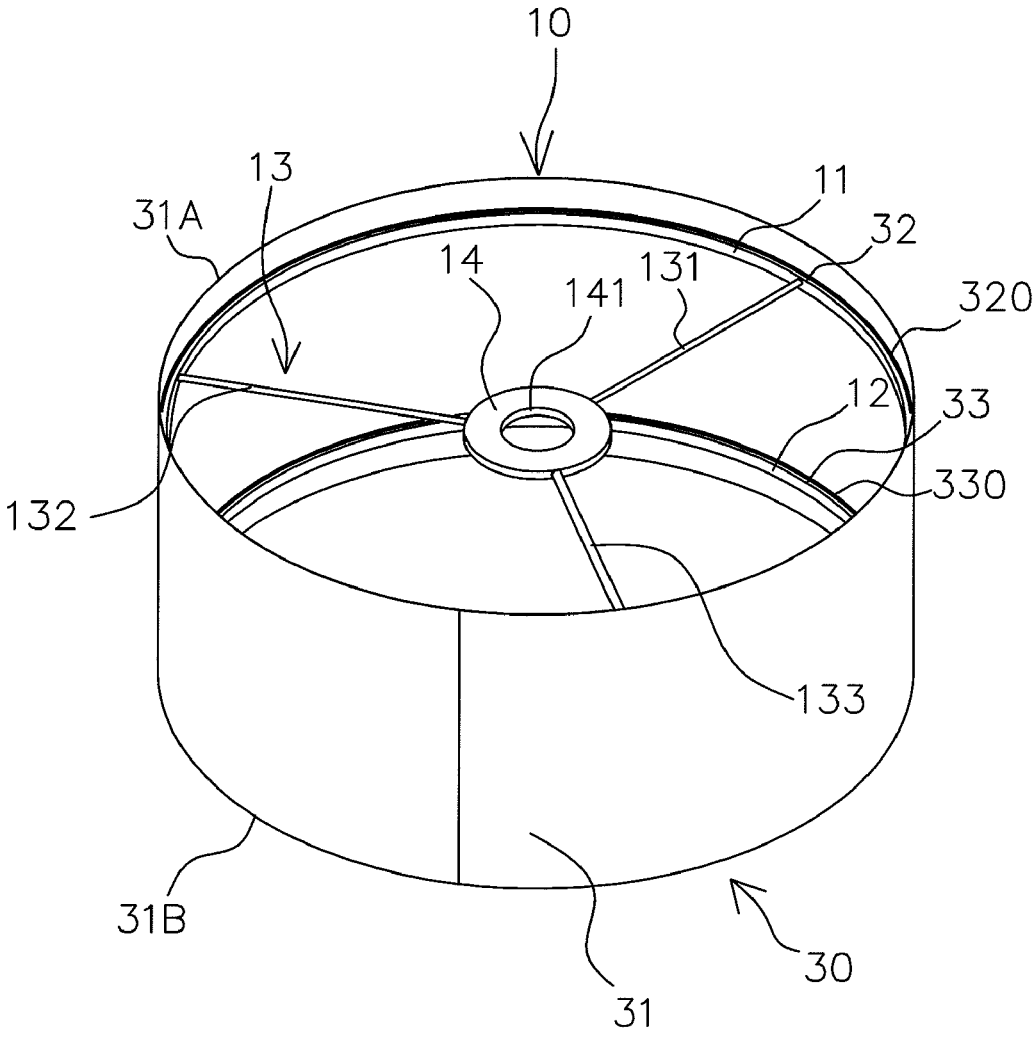
FIG. 1 is a perspective view of a first preferred embodiment of the present invention.

With reference to FIGS. 1, 2 and 2*a* for a magnetic lampshade frame assembly in accordance with a first preferred embodiment of the present invention, the magnetic lampshade frame assembly comprises a frame device 10 and a hood device 30. The frame device 1 comprises an upper frame 11, a lower frame 12 and a link rod seat 13, wherein the upper frame 11 and the lower frame 12 can be made of a metallic material or a magnetic material (such as a magnetic strip or any other material with a magnetic attraction), and the link rod seat 13 is coupled to the upper frame 11. In other preferred embodiments, the link rod seat 13 can be coupled to the lower frame 12, and the link rod seat 13 includes three link rods 131, 132, 133, and an external end of each link rod 131, 132, 133 is coupled to the upper frame 11, and an internal end of each link rod 131, 132, 133 is coupled to a lampshade holder 14, and a through hole 141 is formed at the center of the lampshade holder 14.

The hood device 30 comprises a hood 31, a connecting strip 32, 33 separately formed at upper and lower positions of the internal side of the hood 31, wherein the connecting strips 32, 33 can be made of a magnetic material (such as a magnetic strip or any other material with a magnetic attraction) or a metallic material. In general, the connecting strip 32, 33 made of a magnetic material preferably with an appropriate flexibility, and each of the connecting strips 32, 33 includes a connecting side 320, 330 fixed to an internal side of the hood 31, and a magnetic side 321, 331 formed on a side of the connecting strip 32, 33 opposite to the upper frame 11 or the lower frame 12 (which is opposite to another side of the connecting side 320, 330). When the hood 31 is magnetically coupled to the connecting strip 32, 33, a top portion 31A of the hood 31 is slightly higher and upwardly protruded out with a specific distance from the connecting strip 32. Similarly, the bottom portion 31B of the hood 31 is slightly lower and downwardly protruded out with a specific distance from the connecting strip 33. When the magnetic lampshade frame assembly of the present invention is assembled, the upper frame 11 and the lower frame 12 are magnetically coupled to the magnetic sides 321, 331 of the connecting strip 32, 33 respectively for mounting the hood 31 to the upper frame 11 and the lower frame 12. In this preferred embodiment, the upper frame 11, the lower frame 12 and the connecting strip 32, 33 are in form of a sheet. Since the upper frame 11, the lower frame 12 and the connecting strip 32, 33 are magnetically coupled, therefore the upper frame 11, the lower frame 12 and the connecting strip 32, 33 are made of a magnetic material, or one of the corresponding upper frame 11, lower frame 12 and connecting strip 32, 33 is made of a magnetic material.

With reference to FIGS. 3, 3*a* and 3*b* for a magnetic lampshade frame assembly in accordance with the second preferred embodiment of the present invention, this embodiment is based on the basic structure of the first preferred embodiment, and the difference of these two embodiments resides on that the connecting strip 34 installed at upper and lower end positions of the hood 31 are made of a magnetic material (such as a magnetic strip) substantially L-shaped (or inverted L-shaped), and a connecting side 340 is situated on the external side of the connecting strip 34, and a magnetic side 341 and an abutting side 342 are situated at he internal side of the L-shaped connecting strip 34 and provided for a magnetic connection, and positioning the sheet type upper frame 11 or lower frame 12 in order to mount the hood 31 onto the upper frame 11 and the lower frame 12.

With reference to FIGS. 4, 5 and 6 for a magnetic lampshade frame assembly in accordance with the third preferred embodiment of the present invention, this embodiment is based on the basic structure of the first preferred embodiment, and the difference of these two embodiments resides on that the connecting strips 35 made of a magnetic material (or metallic material) and disposed at upper and lower end portions of the hood 31 have a connecting side 350 on the external side of the connecting strip 35 and an arc shaped magnetic embedding groove 351 formed on the internal side of the connecting strip 35, and the upper frame 11 (or the lower frame) is made of a metallic material or a magnetic material and substantially in the shape of a circular rod, and the magnetic embedding groove 351 is provided for embedding, magnetically coupling the circular rod shaped upper frame 11 (or lower frame) in order to mount the hood 31 onto the upper and lower frames.

With reference to FIG. 7 for a magnetic lampshade frame assembly in accordance with the fourth preferred embodiment of the present invention, this embodiment is based on the basic structure of the third preferred embodiment, and the difference of these two embodiments resides on that the connecting strips 36 are made of a magnetic material (or a metallic material), disposed at upper and lower end portions of the hood 31, and being an arc-shaped body (or a hemispheric body), and a connecting side 360 is situated at the external side of the connecting strip 36, and an arc shaped magnetic embedding groove 361 is formed on the internal side of the connecting strip 36 and provided for embedding and magnetically coupling the circular rod shaped upper frame 11 (or lower frame) in order to mount the hood 31 onto the upper and lower frames.

With reference to FIG. 8 for a magnetic lampshade frame assembly in accordance with the fifth preferred embodiment of the present invention, this embodiment is based on the basic structure of the third preferred embodiment, and the difference of these two embodiments resides on that the connecting strips 37 are disposed at upper and lower end position of the hood 31 are made of a magnetic material (or a metallic material) and have a connecting side 370 situated at the external side of the connecting strip 37 and a square magnetic embedding groove 371 formed on the internal side of the connecting strip 37, and a stop portion 372 is disposed on a distal side of the magnetic embedding groove 371, and the upper frame 15 (or lower frame) is installed at a position corresponding to the square rod shaped metallic material or magnetic material, and the magnetic embedding groove 371 is provided for embedding and magnetically coupling the square rod shaped upper frame 15 (or lower frame), and the upper frame 15 (or lower frame) embedded into the magnetic embedding groove 371) is stopped by the stop portion 372 to prevent the upper frame 15 (or lower frame) from falling out, in order to mount the hood 31 onto the upper and lower frames. In the aforementioned preferred embodiments, the connecting side situated at the external side of the connecting strip preferably has a flat surface, and the internal side of the connecting strip is substantially a flat surface, an arc surface, a hemispherical surface or a surface of any other shape, and the magnetic embedding groove can be an embedding groove in a square shape, an arc shape or any other shape. During assembling, the upper frame and the lower frame are installed corresponding to the magnetic embedding grooves.

With the aforementioned components, the magnetic lampshade frame assembly of the present invention can achieve the effects of saving the material of the lamp, assembling or disassembly a lampshade quickly and conveniently, avoiding damages of a lampshade, providing a secured connection between the hood and the frame, and improving the texture to enhance the added value of the lamp product.

In summation of the description above, the present invention complies with the patent application requirements, and is thus duly filed for patent application. While the invention has been described with reference to a preferred embodiment thereof, it is to be understood that modifications or variations may be easily made without departing from the spirit of this invention, which is defined in the appended claims.

What is claimed is:

1. A magnetic lampshade frame assembly, comprising:

a frame device, including an upper frame and a lower frame;

a hood device, including a hood, a connecting strip separately formed at upper and lower positions of an internal side of the hood, and an external side of the connecting strip being fixed to the hood, and an internal side of the connecting strip being magnetically coupled to the upper frame or the lower frame, and at least one of the connecting strip and the upper frame or at least one of the connecting strip and the lower frame is made of a magnetic material.

2. The magnetic lampshade frame assembly of claim 1, wherein the upper frame and the lower frame are made of a metallic material or a magnetic material, and the connecting strip is made of a magnetic material or a metallic material correspondingly.

3. The magnetic lampshade frame assembly of claim 1, wherein the frame device further includes a link rod seat, and the link rod seat includes a plurality of link rods, and an external end of each link rod is coupled to the upper frame or the lower frame, and an inner end of the link rod is coupled to a lampshade holder, and a through hole is formed at the center of the lampshade holder.

4. The magnetic lampshade frame assembly of claim 1, wherein the connecting strip is made of a flexible magnetic material.

5. The magnetic lampshade frame assembly of claim 1, wherein the connecting strip and the upper frame and the lower frame are substantially in form of a sheet.

6. The magnetic lampshade frame assembly of claim 1, wherein the connecting strips are made of a magnetic material and substantially L-shaped or inverted L-shaped, and a magnetic side and an abutting side are formed on internal sides of the L-shaped or inverted L-shaped connecting strips.

7. The magnetic lampshade frame assembly of claim 1, wherein the connecting strip includes an arc-shaped magnetic embedding groove formed on an internal side of the connecting strip.

8. The magnetic lampshade frame assembly of claim 1, wherein the connecting strip has an internal side substantially being an arc body or a semicircular body, and an arc shaped magnetic embedding groove formed on the internal side of the connecting strip.

9. The magnetic lampshade frame assembly of claim 1, wherein the connecting strip includes a square magnetic embedding groove formed on an internal side of the connecting strip, and a stop portion formed on a distal side of the magnetic embedding groove.

10. The magnetic lampshade frame assembly of claim 1, wherein the hood has a top portion upwardly protruded with a specific distance out from the upper connecting strip, and a bottom portion downwardly protruded with a specific distance out from the lower connecting strip.

* * * * *